US006293340B1

(12) United States Patent
Wu

(10) Patent No.: US 6,293,340 B1
(45) Date of Patent: Sep. 25, 2001

(54) GAS-LIFT-BALL CONTROL DEVICE AND OIL PRODUCING METHOD USING SAID DEVICE

(76) Inventor: Chenglin Wu, Room 501, Unit 2, Building 5, Xingfuxiaoquzhongqu Dagang Oil Field, 300280 Tianjin City (CN)

( * ) Notice: Subject to any disclaimer, the term of this patent is extended or adjusted under 35 U.S.C. 154(b) by 0 days.

(21) Appl. No.: 09/423,424

(22) PCT Filed: Jul. 28, 1997

(86) PCT No.: PCT/CN97/00074

§ 371 Date: May 3, 2000

§ 102(e) Date: May 3, 2000

(87) PCT Pub. No.: WO98/50677

PCT Pub. Date: Nov. 12, 1998

(30) Foreign Application Priority Data

May 8, 1997 (CN) ..... 97111789

(51) Int. Cl.[7] ..... E21B 43/00

(52) U.S. Cl. ..... 166/105.5; 166/90.1; 166/75.12; 166/243

(58) Field of Search ..... 166/105.5, 105.6, 166/263, 68.5, 69, 72, 75.11, 90.1, 75.15, 75.12, 97.5, 243

(56) References Cited

U.S. PATENT DOCUMENTS

| | | | |
|---|---|---|---|
| 3,120,265 | | 2/1964 | Allen . |
| 4,269,279 | * | 5/1981 | House . |
| 4,682,656 | | 7/1987 | Waters . |
| 4,711,306 | | 12/1987 | Bobo . |
| 5,450,901 | | 9/1995 | Ellwood . |

FOREIGN PATENT DOCUMENTS

| | | |
|---|---|---|
| 2040532 | 7/1989 | (CN) . |
| 1042395 | 5/1990 | (CN) . |
| 2 068 147 | 12/1990 | (CN) . |
| 2189202 | 2/1995 | (CN) . |
| 2074813 | 4/1999 | (CN) . |
| 2239193 | 6/1991 | (GB) . |
| 801855 | 2/1981 | (SU) . |
| 1307101 | 4/1987 | (SU) . |
| 1819322 | 5/1993 | (SU) . |

* cited by examiner

*Primary Examiner*—Roger Schoeppel
(74) *Attorney, Agent, or Firm*—Kenyon & Kenyon

(57) ABSTRACT

This invention relates to a gas-lift ball control device in gas-lift ball oil recovery and a method of oil recovery with the device. In the device a low pressure gas outlet, an oil-gas-ball inlet and an oil outlet are provided on casing of an oil-gas-ball separator. A spiral pipe communicating with the oil-gas-ball inlet is provided within the casing. There is a separating umbrella on the spiral pipe and a filter below the spiral pipe. There is a ball-distributing valve inside the filter. The valve body is provided with a ball-entry bore, a low pressure gas-bore, a high pressure gas-entry bore and a high pressure gas-exit bore. There is a gas path communicating with said two pairs of bore in a manner of rotation or sliding. Gas and balls can be continuously supplied to a gas transporting pipe through the ball-distributing valve. The device is efficient with less gas and simple structure. It can be easily made and be securely and reliably operated. The method relates to a method of oil recovery with the gas-lift ball control device.

10 Claims, 5 Drawing Sheets

GAS-LIFT-BALL CONTROL DEVICE AND OIL PRODUCING METHOD USING SAID DEVICE

TECHNICAL FIELD

The present invention relates to a gas-lift-ball control device used in oil production and an oil producing method using the gas-lift-ball control device.

BACKGROUND OF INVENTION

The applicant filed an application for patent on Jul. 7, 1990 in China and the patent right was granted to it thereafter, the title of the invention being "A GAS-LIFT OIL PRODUCING DEVICE" and the patent number being 90209934.5. The said device comprises a conventional gas-lift unit and a ball-control mechanism, makes a slug flow in the lift pipe with gas column mixed with well fluid being separated by feeding special gas-lift-balls at regular intervals so that the gas energy can be used to it's maximum and the injection-production ratio is reduced, producing depth is increased, therefore, the gas-lift efficiency is improved.

The ball-control mechanism consists of motor, gear bank, screw rod, oil-gas-ball separator, ball-control wheel, circular-cylinder-shape filter screen, oil-gas-ball inlet pipe and valve, high pressure gas inlet pipe and valve, oil-gas outlet pipe and valve, gas-ball outlet pipe and valve. The mechanism is of bilateral symmetry (left and right). The spiral direction of the left screw rod is opposite to the right one. A valves are connected with the pipelines and the shell of the oil-gas separator. Each pair of valves is connected with the gears and screw rod.

After high pressure gas from high pressure valve goes into the separator, the ball-control wheel turns under the force of the gas flow, and passes the gas-lift-balls into the gas-feeding pipe, forming a kind of flow structure of gas column separated with the gas-lift-balls. When the motor rotates clockwise, the screw rod will open the valve on the left and close the valve on the right. When the left valve opens, oil and gas and ball go into the left separator, with oil and gas going into the oil-gas outlet pipeline through the filter screen. When the left separator is filled with the balls, the motor begins turning anticlockwise. The right valve opens and the left valve closes. When the right valve opens, oil and gas and ball go into the right separator, with oil and gas going into the oil-gas outlet pipeline through the circular-cylinder-shape filter screen.

On May 13, 1994, the applicant filed an application for patent ("THE MULTIFUNCTION BALL-CONTROL DEVICE"), which was improved on the basis of the above-mentioned device. A patent was granted to it and the patent number is 9421188.5. The device takes advantage of the transmission and controlling mechanism and the bilateral symmetry of the above-mentioned device. In this ball-control device, the gas-lift-balls are separated by filter screen, the speed-regulating motor is used, the gear bank is used to control the spiral ball feeder which controls the balls delivery. And also, a spiral oil ditch with some small holes on it was designed, there is a baffle at the end of the oil ditch, on the top of which a separation cap is located for separating gas and oil. Nevertheless, the improved device has the following shortcomings: 1) the structure is complicated and expensive because of using the motor and gear bank and screw rod to control the two shells; 2) the safety degree is reduced and the investment enlarged because of the high pressure of 8–12 Mpa that the two shells have to be subjected to when injecting gas; 3) the feeding of gas and balls is not continuous, therefore, the pressure fluctuates because the two shells send out and receive balls and separate oil and gas respectively, and also, regular tank change must be proceeded; and 4) it is somewhat difficult to operate because of the bilateral symmetry structure. So, to some extent, the above two patents are difficult to be put into practice.

SUMMARY OF THE INVENTION

It is an object of the present invention to provide a gas-lift-ball control device as well as a method of oil production using the device, in which only one low pressure shell is used, and the feeding of gas and balls can be continuous. So there is no fluctuation in pressure in oil-gas gathering and transferring system, the safely and reliability can be ensured, and the needed injection gas amount is reduced and the gas lift efficiency increased in comparison with the devices of the above-mentioned two patents.

According to an aspect of the present invention, there is provided a gas-lift-ball control device, comprising an oil-gas-ball separator shell which is provided with a low pressure gas outlet on the top, an oil-gas-ball inlet on the upper portion and an oil outlet on the lower portion; a perforated spiral pipe which is located inside the separator shell and connected on one end with the oil-gas-ball inlet; a baffle arranged in front of the other end of the perforated spiral pipe; a separating umbrella disposed above the perforated spiral pipe; and a filter screen disposed below the perforated spiral pipe. According to the present invention, a valve for sending out gas-lift-balls is arranged by the side of the filter screen and comprises a valve body having a ball inlet hole, a low pressure gas hole, a high pressure gas inlet hole an a high pressure gas outlet hole, and a valve core which is positioned in the valve body and controlled by an electric control unit. The high pressure gas inlet hole and the high pressure gas outlet hole are connected respectively with a high pressure gas inlet pipe and a high pressure gas outlet pipe, which extend through the shell wall to the outside. The valve core is provided therein with passage means for connecting the ball inlet hole and the low pressure gas hole in the valve body and for connecting the high pressure gas inlet hole and the high pressure outlet hole in the valve body alternatively. A shift fork is disposed by the side of the ball inlet hole and controlled by the electric control unit.

The oil producing method using the gas-lift-ball control device according to the present invention is now described. The gas-lift-ball control device is installed in an oil production line. The high pressure gas inlet pipe of the gas-lift-ball control device is connected with a high pressure gas resource via a valve. The high pressure gas outlet pipe of the gas-lift-ball control device is connected with a gas delivery pipe. The low pressure gas outlet of the gas-lift-ball control device is connected with a gas recovery pipe of the high pressure gas resource. The oil outlet of the device is connected with an oil transferring pipe. The oil-gas-ball inlet of the device is connected with a gas lift pipe. The high pressure gas is first introduced into the annular space between the casing and tubing to press the liquid level to a required depth. The gas-lift-balls are then put into the separator shell and the electric control unit is started to drive the shift fork so that the gas-lift-balls can be sent into the ball inlet hole in the valve body of the valve for sending out gas-lift-balls successively, and the valve core is driven to connect the ball inlet hole with the low pressure gas hole in the valve body and connect the high pressure gas inlet hole and the high pressure outlet hole in the valve body alternatively. In this manner, the balls and gas are delivered to the gas delivery pipe continuously. The gas-lift-balls and the oil and gas coming from a tailpipe get into the gas lift pipe, and then into the separator shell to separate oil/gas/balls. The gas and balls are recovered for reuse and the oil is transferred from the oil outlet. In this way, the slug flow of oil and gas being separated by balls is formed, the gas lift efficiency is increased. In addition, because the valve sends the balls and gas into the oil well continuously and the separator separates oil, gas and balls (the separated oil going to the gathering and transferring pipe after measuring, the separated gas going to the compressor for reuse, the separated balls staying in the shell for reuse.), the structure of the device is simple, and safety and reliability can be guaranteed.

For this invention, there can be two kinds of valves for sending out balls. One is the slide valve, the other is the rotary valve. When using the rotary valve in the device, the rotary valve body and the valve core which can turn in the valve body will be used. A speed-regulating electric motor and gear reduction unit fixed outside the separator shell will be used as the electric control unit. The valve core of the rotary valve is fixed on the output shaft of the speed-regulating motor and gear reduction unit, the diameter of the gas-lift-balls is bigger than the diameter of one end of the passage provided in the valve core and smaller than the diameter of the other end. When the valve core turns clockwise, the ends of the passage will connect the ball inlet hole and the low pressure gas outlet hole, and the high pressure gas inlet hole and the high pressure gas outlet hole alternatively. The drive conic gear is fixed on the output shaft of the speed-regulating motor and gear reduction unit, and the driven conic gear drives the driven shaft on which the shift fork is fixed. The mating surfaces between the rotary valve body and the valve core can be conic, cylindrical, or spherical.

In the rotary valve for sending out balls, the passage means can comprise a straight line passage, or two broken line passages, or two curve passages, and the ball inlet hole, the high pressure gas outlet hole, the low pressure gas hole and the high pressure inlet hole should be arranged correspondingly in the valve body.

In the rotary valve for sending out balls with a straight line passage, the ball inlet hole, the high pressure gas outlet hole, the low pressure gas hole and the high pressure inlet hole are evenly distributed in said order in the valve body at 90° intervals.

In the rotary valve for sending out balls with two broken line passages or two curve passages, the ball inlet hole is arranged adjacent to the low pressure gas hole and the high pressure outlet hole adjacent to the high pressure inlet hole.

The gas-lift-ball control device according to the present invention can use a slide valve for sending out balls, in which the valve for sending out balls is a slide valve, the valve body is a slide valve body, the valve core is a slide valve core which slides back and forth in the valve body, and the speed-regulating motor and gear reduction unit is disposed outside the separator shell. A crank of a crank-link-block unit is articulated with the output shaft of the speed-regulating motor and gear reduction unit. The valve core of the slide valve is fixed on the shift lever of the crank-link-block unit. There are two passages in the valve core: the first passage and the second passage. The first passage is for low pressure gas, the diameter of which is smaller than that of the gas-lift-balls. The second passage is for high pressure gas and the balls. The shift fork is provided with a plurality of claws and fixed on the rod of the crank-link-block unit through another little rod which is perpendicular to the rod of the crank-link-block unit. The mating surfaces between the valve body and the valve core of the slide valve can be rectangular or cylindrical or any other suitable shape.

An automatic control unit for discharging oil can be used in the gas-lift-ball control device according to the present invention. A floating ball is disposed below the filter screen and a valve is disposed at the oil outlet. A lever and weight unit is disposed outside the separator shell to control the opening of the oil outlet valve. The floating ball and the lever and weight unit are known in the art.

The gas-lift-ball control device according to the present invention is equipped with a heating mechanism to prevent the oil in the separator shell from freezing. For example, a coiled radiator is disposed in the separator shell. The outlet and inlet of the coiled radiator are respectively connected to a steam circulating pipeline. A safety head, a safety valve and a pressure gauge are disposed on the separator shell. By the side of the filter screen and above it two holes are disposed respectively for picking up balls and loading balls. Each of the two holes is provided with a sealed cap.

In the gas-lift-ball control device according to the present invention, the separator shell is provided with a drain pipe on the bottom. A drain valve is disposed on the drain pipe.

DETAILED DESCRIPTION OF THE PREFERRED EMBODIMENTS

Embodiment I

Figure 1:
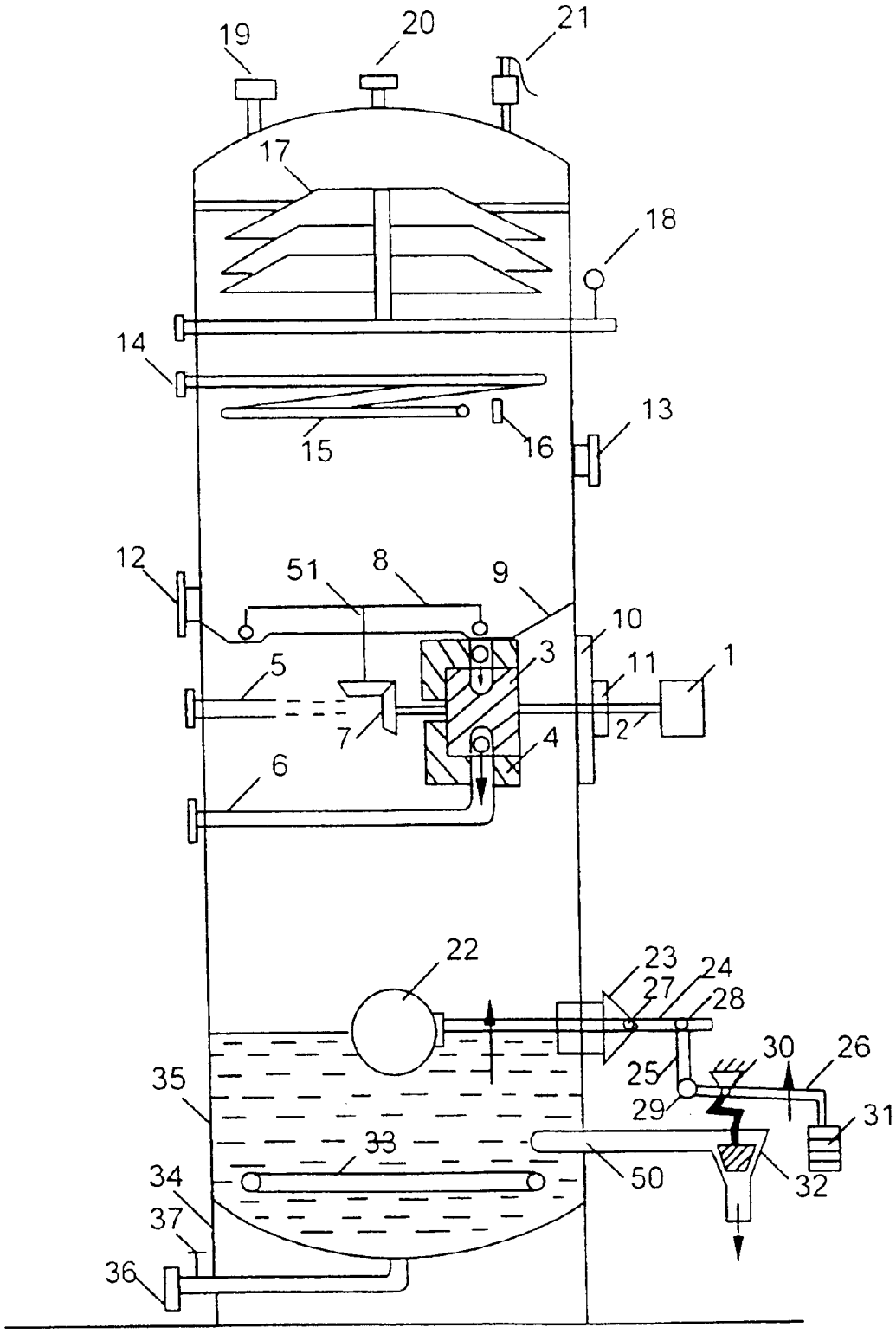
FIG. 1 is a schematic diagram of the gas-lift-ball control device according to the present invention with a rotary valve for sending out balls.
Figure 3:
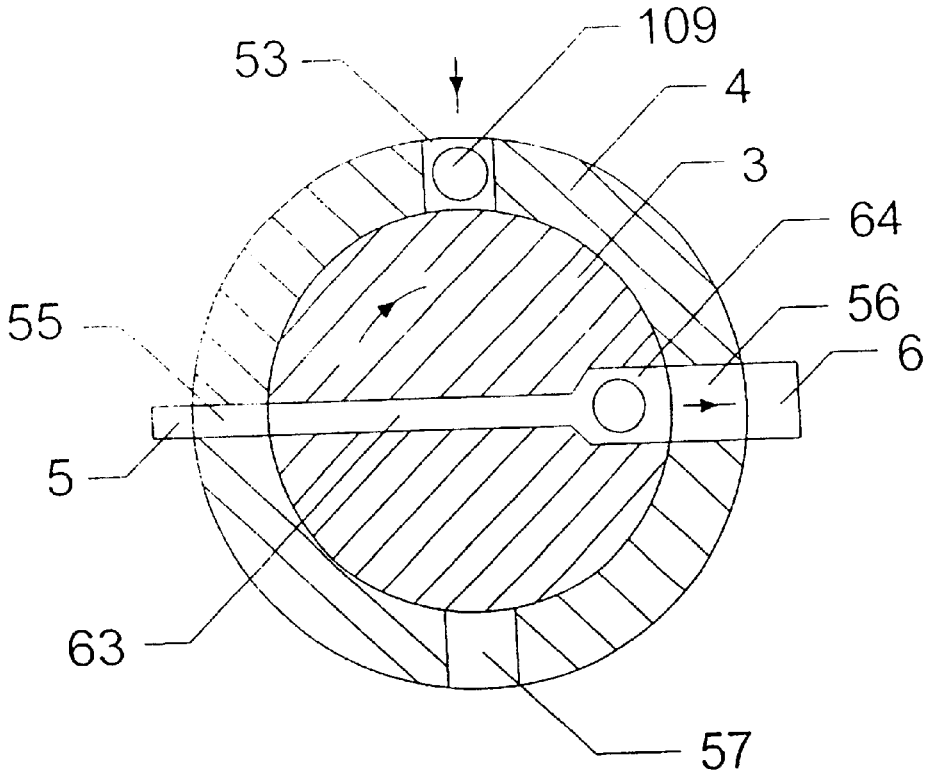
FIG. 3 is a schematic diagram of the structure of the rotary valve for sending out balls with a straight line passage.
Figure 4:
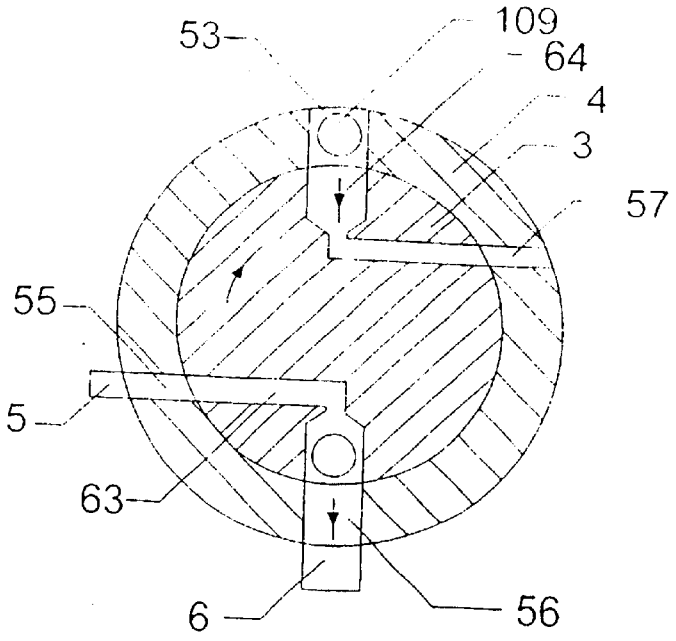
FIG. 4 is a schematic diagram of the structure of the rotary valve for sending out balls with two broken line passages.
Figure 5:
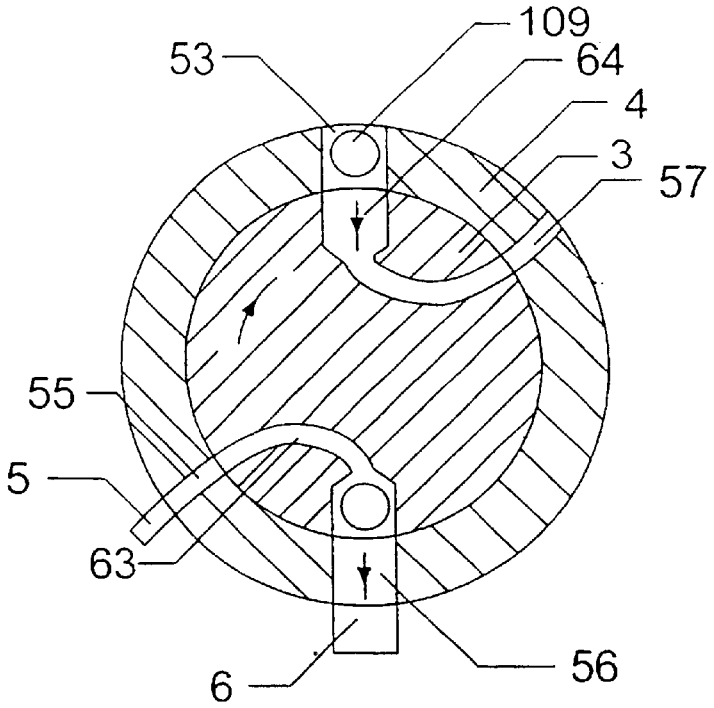
FIG. 5 is a schematic diagram of the structure of the rotary valve for sending out balls with two curve passages.
Figure 7:
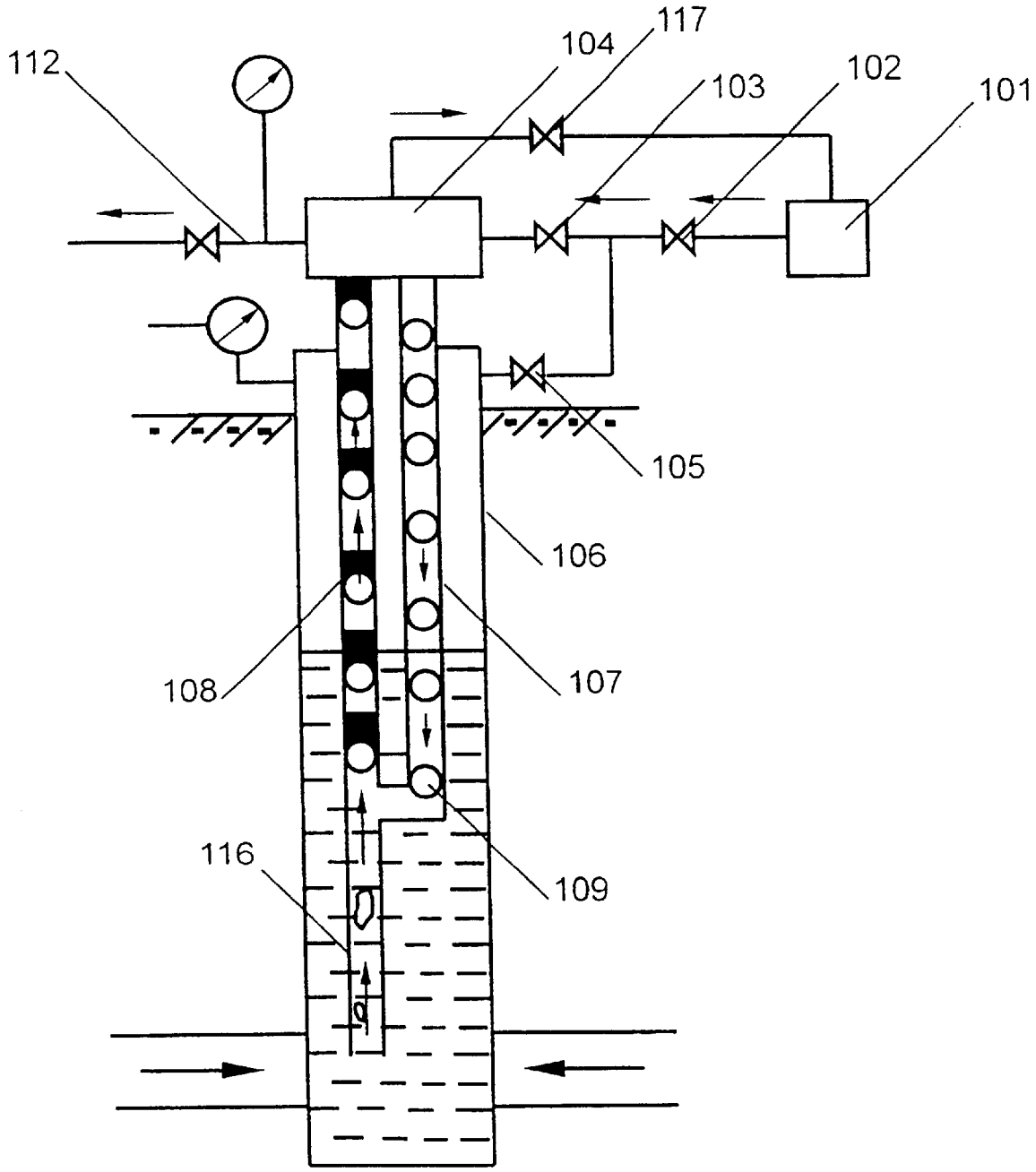
FIG. 7 is a schematic diagram showing the gas-lift-ball control device installed in an oil producing pipeline.

In the gas-lift-ball control device used in oil production according to the first embodiment of present invention, a rotary valve is used for sending out gas-lift-balls. As shown in FIG. 1, a low pressure gas outlet 20, an oil-gas-ball inlet 14 and an oil outlet 50 are provided respectively on the top, the upper and lower portions of an oil-gas-ball separator shell 35. In the interior of the oil-gas shell 35 is provided a perforated spiral pipe 15, the outer end of which is connected with the oil-gas-ball inlet 14. A baffle 16 is positioned in front of the other end of the spiral pipe 15. A separating umbrella 17 is disposed above the spiral pipe 15 and a filter screen 16 is located below the spiral pipe 15. The structure described above is known in the art. The improvements of the present invention are as follows. A speed-regulating motor and gear reduction unit 1 is installed outside the shell 35. An output shaft 2 of the speed-regulating motor and gear reduction unit 1 extends into the shell 35 through a seal ring 11 on a manhole cover 10 on the shell 35 and connects with a rotary valve core 3 and the drive conic gear of a pair of conic gears 7. The driven shaft 51 of the driven conic gear of the pair of conic gears 7 is coaxial with the centerline of the shell 35. The upper end of the driven shaft 51 is located above the filter screen 9 and is connected with a shift fork 8. The rotary valve is disposed by the side of the filter screen 9. The upper surface of the valve body 4 of the rotary valve is located in the same plane as the lower rim of the filter screen 9. The ball inlet hole 53 in the valve body 4 is perpendicular to the upper horizontal surface of the rotary valve body 4. There can be three kinds of structures for the rotary valve for sending out gas-lift-balls. They are the rotary valve with a straight line passage (as shown in FIG. 3), the rotary valve with two broke line passages (as shown in FIG. 4) and the rotary valve with two curve passages (as shown in FIG. 5). As shown in FIGS. 3, 4 and 5, the rotary valve body 4 has four through holes, i.e., a ball inlet hole 53, a low pressure gas hole 57, a high pressure gas inlet hole 55 and a high pressure gas outlet hole 56. The rotary valve with a straight line passage has a straight line passage 150 provided in the valve core 3. Both the rotary valve with broken line passages and the rotary valve with curve passages have two passages, i.e. the first passage 64 and the second passage 63 provided in the valve core 3. The output shaft 2 drives the valve core 3 to rotate and correspondingly links the two pairs of holes through the passages. A high pressure gas inlet pipe 5 and a high pressure gas outlet pipe 6 are connected respectively with the high pressure gas inlet hole 55 and the high pressure outlet hole 56 and extend to the outside of the shell 35. In operation of the gas-lift-ball control device according to the present invention, the gas-lift-ball control device is first installed in the production line as shown in FIG. 7. A high pressure gas resource 101 is connected with the high pressure gas inlet pipe 5 of the gas-lift-ball control device 104 through a valve 102 and an inlet valve 103. The high pressure gas outlet pipe of the gas-lift-ball control device 104 is connected with a gas delivery pipe 107 in an oil well. The oil-gas-ball inlet 14 of the gas-lift ball control device 104 is connected with a lift pipe 108 in the oil well. The low pressure gas outlet 20 is communicated with a gas recovery pipe of the high pressure gas resource 101 through a gas valve 117. The oil outlet 50 of the gas-lift-ball control device 104 is connected with an oil transferring pipeline 112. As in the conventional method of gas lift recovery, when opening the valve 102 and a casing gas inlet valve 105, the high pressure gas flows into an annular space between the casing 106 and the tubing, pushing the liquid in the oil well to a certain depth. The device 104 is started. The gas inlet valve 103 is opened, transferring the high pressure gas into the high pressure gas inlet pipe 5. As shown in FIGS. 1, 3, 4, and 5, the speed regulating motor and gear reduction unit 1 is started, driving the rotary valve core 3 to rotate, and making the shift fork 8 work. The shift fork 8 successively shifts the balls 109 which have been loaded in the device 104 into the ball inlet hole 53 in the rotary valve body 4. In the rotary valve with a straight line passage as shown in FIG. 3, when the valve core 3 is rotated, the bigger end of the straight line passage 150 joins the ball inlet hole 53 and the smaller end joins the low pressure gas hole 57, whereby a gas-lift-ball 109 is introduced into the bigger end of the straight line passage under the gravity and the pressure. When the rotary valve core 3 continues to rotate, the bigger end of the straight line passage 150 in the valve core 3 joins the high pressure gas outlet hole 56 and the smaller and joins the high pressure gas inlet hole 55, whereby the gas-lift-ball 109 is pushed out of the device 104 by the high pressure gas flow. In the rotary valve with broken line passages or with curve passages, when the valve core 3 is rotated, the first passage 64 links the ball inlet hole 53 and the low pressure hole 57, whereby a gas-lift-ball 109 enters the first passage 64 in the valve core 3 under the gravity and the pressure. When the valve core 3 is further rotated, the first passage 64 links the high pressure gas inlet hole 55 and the high pressure gas outlet hole 56, whereby the gas-lift-ball 109 is pushed out of the device 104 by the high pressure gas flow and enters the gas delivery pipe 107, and at the same time, the second passage 63 links the ball inlet hole 53 and the low pressure gas hole 57, whereby a gas-lift-ball enters the second passage 63. In this manner, the gas-lift-balls are successively sent into the gas delivery pipe 107. The speed of sending out balls can be changed by regulating the speed of the motor. The gas-lift-balls 109 are hollow balls made of nylon with a small hole in each ball. The clearance between the ball and the inner surface of the gas lift pipe 108 should be as smaller as possible so that the gas-lift-balls can move smoothly in the gas lift pipe. As shown in FIG. 7, the devise 104 sends out the balls at a certain speed to the gas delivery pipe 107 so that the structure of flowing gas column separated by balls at intervals is formed in the gas delivery pipe 107. When a gas-lift-ball 109 flows to the T point of the gas lift pipe 108, a tailpipe 116 and the gas delivery pipe 107, the gas-lift-ball 109 enters the gas lift pipe 108 together with the oil and gas coming from the tailpipe 116 so that the slug flow structure is formed in the gas lift pipe 107 with the ball on the top of one column of gas and with one column of oil on the ball, and the gas lift efficiency is thus improved. In order to prevent the balls from being stuck at the T point, the gas delivery pipe and the gas lift pipe can be connected through a bend of 180°. The bend has some holes which have a diameter smaller than the diameter of the gas-lift-balls and which are in communication with the tailpipe 116. The mixture of oil, gas and the balls in the gas lift pipe 108 gets into the perforated spiral pipe 15 in the separator shell. Due to gas leaking and pressure reducing effect of the perforated spiral pipe 15, the gas-lift-balls 109 are separated and drop on the filter screen 9 for reuse. Oil and gas are separated because of the centrifugal force, gravity and the absorption of the separating umbrella 17 to the liquid drops. The separated gas from the low pressure gas outlet 20 is transferred through the gas recovery pipe into the high pressure gas resource 101 for reuse. The separated oil from the oil outlet 50 is transferred into a metering station.

An automatic control unit for controlling oil outflow is disposed in the devise 104. As shown in FIG. 1, A floating ball 22 is disposed below the filter screen 9, an oil outflow valve 32 is disposed at the oil outlet 50, and a lever and weight unit is disposed outside the separator shell 35. The lever and weight unit consists of an upper horizontal rod 24, a vertical rod 25, a lower horizontal rod 26 and an adjustable weight 31. The upper horizontal rod 24, the vertical rod 25 and the lower horizontal rod 26 are articulated in said order through two pins 28 and 29. The upper horizontal rod 24 is fitted at a float buoy manhole unit 23 through a pin 27. The rod 24 extends into the separator shell 35 and is connected with the float ball 22. The middle of the rod 26 is fixed at the oil outlet valve 32 through a shaft 30, and the adjustable weight 31 is hooked at the end of the rod 26. The float ball 22 can be moved up and down with the float force of the liquid in the shell 35. When the liquid level moves up, the float ball 22 will be moved up so as to swing the rod 24 about the pin 27. The rod 24 drives the lower horizontal rod 26 through the vertical rod 25. The rod 26 drives the shaft 30 provided on the rod 26 to rotate anticlockwise for an angle so as to drive a lever fixed at the shaft 30 to swing anticlockwise. The end of lever drives the conic valve core to move up, and the opening of the oil outlet valve 32 becomes bigger. The oil flow rate to the metering station is increased and the liquid level in the shell 35 moves down. On the other hand, when the liquid level in the shell 35 moves down, the float ball 22 is moved down to reduce the opening of the oil outlet valve 32. The adjustable weight 31 is used to control the liquid level in the shell 35, but its effect is opposite to the effect of the float ball 22 on the oil outlet valve 32.

As shown in FIG. 1, a heating coil 33 for heating the oil is provided in the separator shell 35. A hole 12 for picking up the balls and a hole 13 for loading the balls are provided on the shell 35, and sealed caps are provided on the holes 12 and 13. There are also a safety head 19, a safety valve 21 and a pressure gauge 18 on the shell 35. A drain pipe 36 with a valve 37 is located on the bottom of the shell 35. The shell 35 is fixed on a substructure 34.

Embodiment II

Figure 2:
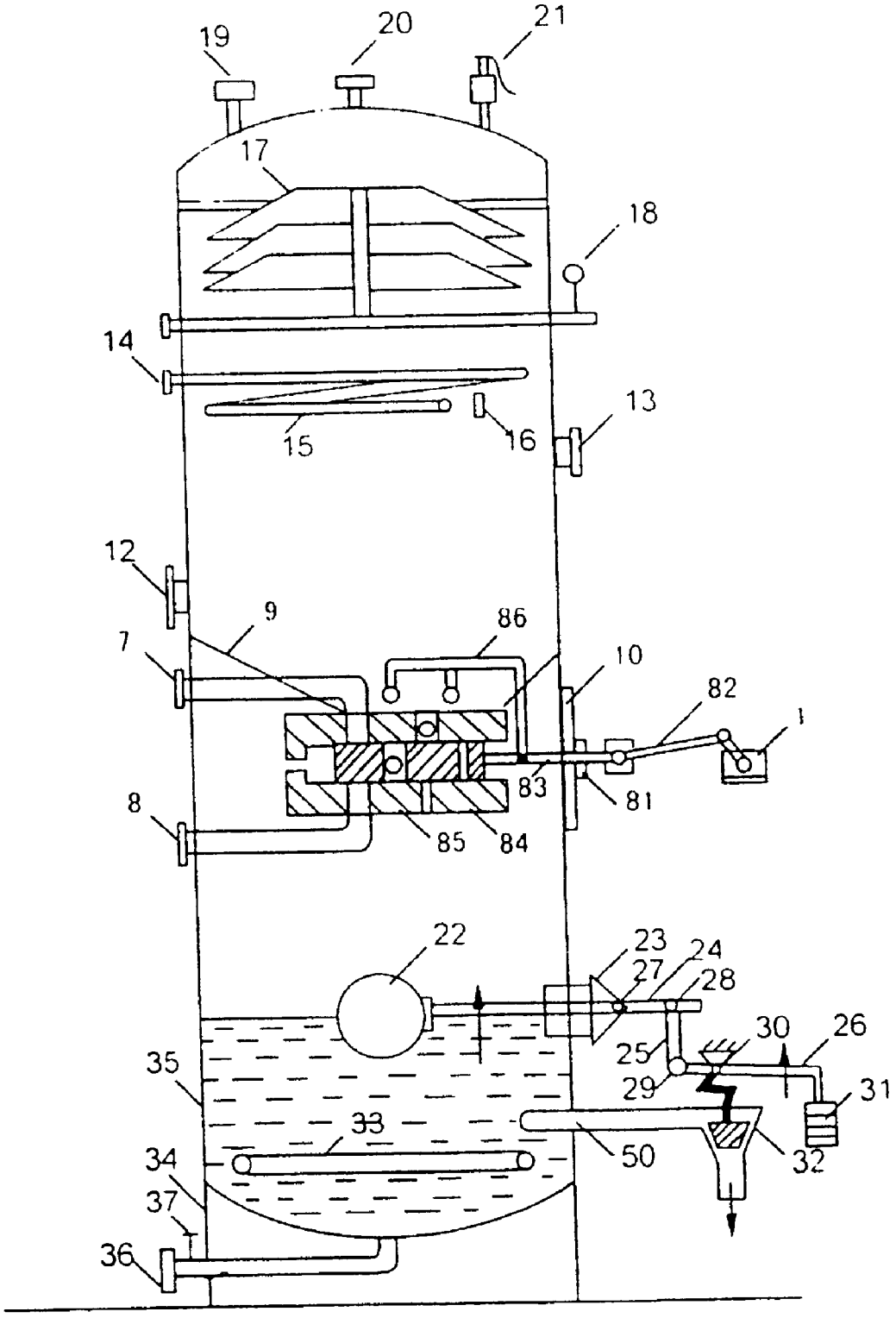
FIG. 2 is a schematic diagram of the gas-lift-ball control device according to the present invention with a slide valve for sending out balls.
Figure 6:
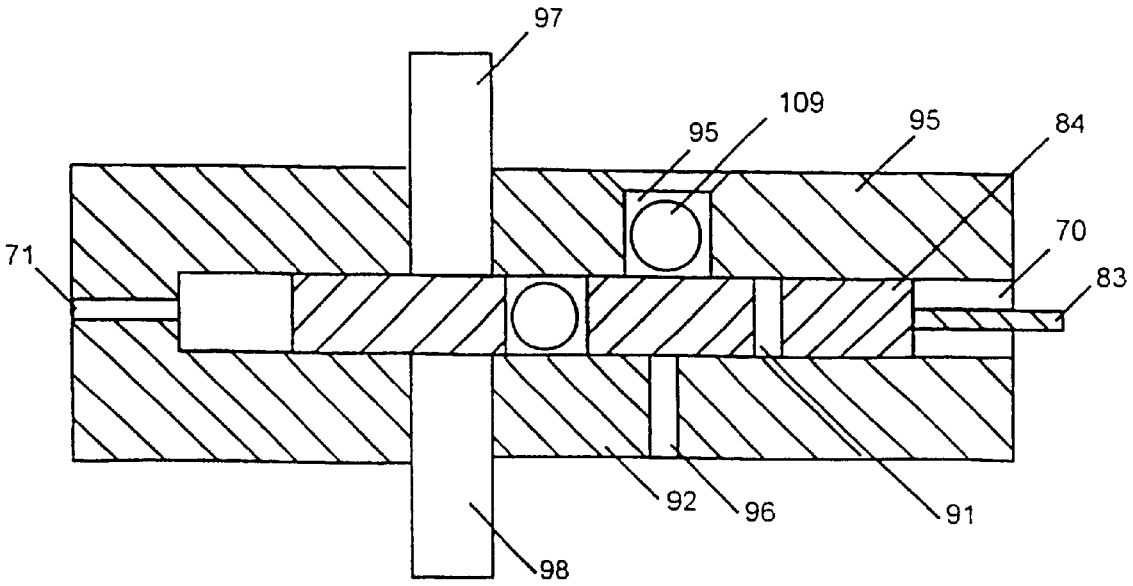
FIG. 6 is a schematic diagram of the structure of the slide valve for sending out balls.

As shown in FIGS. 2 and 6, the gas-lift-ball control device according to the second embodiment of the present invention employs a slide valve for sending out balls. The structure of this device is the same as that of the first embodiment except for the valve for sending out balls and the shift fork. A speed-regulating motor and gear reduction unit 1 and a crank-link-block unit 82 are installed outside the shell 35. The crank of the unit 82 is articulated with the output shaft of the unit 1. The rod 83 of the unit 82 extends into the shell 35 through a seal 81 fixed on a manhole cover 10 on the shell 35. Inside the shell 35, the rod 83 is connected with the valve core 84 of the slide valve and with a shift fork 86 through a connecting rod. The slide valve for sending out balls is positioned below a filter screen 9 which is in an inclined plane. The upper surface of the valve body 85 links the inclined plane of the filter screen. The ball inlet hole 95 is perpendicular to the upper surface of the valve body 85 as shown in FIG. 6. A hole 70 for the movement of the rod 83 and a balance hole are provided in the valve body 85. The ball inlet hole 95, a low pressure gas hole 96, a high pressure gas inlet hole 97 and a high pressure gas outlet hole 98 are provided in the valve body 85. Two passages 91 and 92 are provided in the valve core 84. The valve core 84 is driven by the rod to slide in the valve body. When the valve core 84 slides to an outer limit, the second passage 92 links the ball inlet hole 95 and the low pressure gas hole 96 so that the gas-lift-ball 109 in the ball inlet hole 95 goes into the passage 92. When the valve core 84 moves to an inner limit, the first passage 92 links the high pressure gas inlet hole 97 and the high pressure gas outlet hole 98, whereby the high pressure gas from a pipe 7 forces the gas-lift-ball 109 into a high pressure gas outlet pipe 8 and into a gas delivery pipe in the oil well, and at the same time, the passage 91 links the ball inlet hole 95 and the low pressure gas hole 96, whereby a gas-lift-ball is driven into the ball inlet hole 95 by the shift fork 86. In this manner, the rod 83 drives the valve core to slide back and forth, so that gas and balls are successively sent into the gas delivery pipe. The other structure of the second embodiment is the same as that of the first embodiment and will not be described in detail. The speed-regulating motor and gear reduction units in the first and second embodiments are the same and available in the market.

The present invention is not limited to the gas-lift-ball control devices of the first and second embodiments in which vertical separators are used. The present invention also applies to horizontal separators with rotary or slide valve for sending out the balls.

Industrial Applicability

The present invention has the following advantages as compared with the prior art:

1) The separator shell bears only the low pressure from the oil transferring on the ground, and the pressure from the high pressure gas will be borne by the rotary valve or the slide valve, but the separator shell of the prior art bears high pressure from the gas injection.
2) Only one separator shell is required but the prior art requires two.
3) The cost is reduced by ¾–⅔ compared with the prior art because only one shell, one set of the control valves, and one speed-regulating motor and gear reduction unit are used.
4) The feeding of gas and balls to the gas delivery pipe in the prior art is not continuous but the present invention can guarantee the continuity of feeding gas and balls to the gas delivery pipe, and no pressure fluctuation occurs in the oil and gas transferring system, therefore, safety is improved and the gas amount used can be reduced.

In conclusion, with the gas-lift-ball control device according to the present invention, the gas lift efficiency can be improved, the gas amount used can be reduced, continuous feeding of gas and the balls can be ensured, the device is simple in structure and easy to put into practice and the safety in production can be ensured.

What is claimed is:

1. A gas-lift-ball control device, comprising an oil-gas-ball separator shell which is provided with a low pressure gas outlet on the top, an oil-gas-ball inlet on the upper portion and an oil outlet on the lower portion; a perforated spiral pipe which is disposed inside said shell and connected on one end with said oil-gas-ball inlet; a baffle provided in front of the other end of the perforated spiral pipe; a separating umbrella disposed above said perforated spiral pipe; and a filter screen disposed below said perforated spiral pipe, characterized in that a valve for sending out gas-lift-balls is arranged by the side of the filter screen and comprises a valve body having a ball inlet hole, a low pressure gas hole, a high pressure gas inlet hole and a high pressure gas outlet hole, and a valve core which is positioned in said valve body and controlled by an electric control unit, said high pressure gas inlet hole and said high pressure gas outlet hole being connected respectively with a high pressure gas inlet pipe and a high pressure gas outlet pipe, which extend through the shell wall to the outside; said valve core is provided therein with passage means for connecting said ball inlet hole and said low pressure gas hole and for connecting said high pressure gas inlet hole and said high pressure gas outlet hole alternatively; and a shift fork controlled by said electric control unit is disposed by the side of said ball inlet hole in said valve body.

2. The gas-lift-ball control device according to claim 1, characterized in that said valve for sending out gas-lift-balls is a rotary valve; said valve body is a rotary valve body; said valve core is a rotary valve core which can rotate in said rotary valve body; said electric control unit is a speed-regulating motor and gear reduction unit disposed outside said separator shell; said rotary valve core is fixed on the output shaft of the speed-regulating motor and gear reduction unit; the diameter of one end of said passage means is larger and the diameter of the other end is smaller than the diameter of the gas-lift-balls; when the valve core rotates, the larger end and the smaller end of said passage means connect the ball inlet hole and the low pressure gas hole, and connect the high pressure gas outlet hole and the high pressure gas inlet hole alternatively; and a driving conic gear is fixed on the output shaft of the speed-regulating motor and gear reduction unit and engaged with a driven conic gear to drive the shift fork which is fixed on the shaft of the driven conic gear.

3. The gas-lift-ball control device according to claim 2, characterized in that said passage means is one straight line passage, and said ball inlet hole, said high pressure gas outlet hole, said low pressure gas hole and said high pressure gas inlet hole are evenly distributed in said valve body in said order at intervals of 90 degrees.

4. The gas-lift-ball control device according to claim 2, characterized in that said passage means comprises two broken line passages or two curve passages; said ball inlet hole is arranged adjacent. to said low pressure gas hole and said high pressure gas outlet hole adjacent to said high pressure gas inlet hole.

5. The gas-lift-ball control device according to claim 1, characterized in that said valve for sending out balls is a slide valve, said valve body is a slide valve body, said valve core is a slide valve core which slides back and forth in the slide valve body; said electric control unit is a speed-regulating motor and gear reduction unit disposed outside the separator shell; a crank of a crank-link-block unit is articulated with the output shaft of the speed-regulating motor and gear unit; there are two passages, the first and the second passages in said valve core, the first passage being for low pressure gas and having a diameter smaller than the diameter of the gas-lift-balls and the second passage being for high pressure gas and the balls; said shift fork is provided with a plurality of claws and connected with the rod of the crank-link-block unit by means of another rod perpendicular to said rod.

6. The gas-lift-ball control device according to claim 2 or 5, characterized in that a floating ball is disposed below said filter screen, an oil outlet valve is disposed at said oil outlet, and a lever and weight unit connected with the floating ball is disposed outside the separator shell for controlling the opening of the oil outlet valve.

7. The gas-lift-ball control device according to claim 6, characterized in that a coiled radiator is provided within the separator shell, two pipes connected respectively with the two ends of said coiled radiator extend to the outside of the separator shell.

8. The gas-lift-ball control device according to claim 7, characterized in that a safety head, a safety valve and a pressure gauge are disposed on the separator shell.

9. The gas-lift-ball control device according to claim 8, characterized in that the separator shell is provided with a hole for picking up the gas-lift-balls an a hole for loading the gas-lift-ball respectively by the side of and above the filter screen.

10. An oil producing method using the gas-lift-ball control device according to claim 1, comprising the steps of installing the gas-lift-ball control device in an oil production pipeline, the high pressure gas inlet pipe of the devise being connected with a high pressure resource through a gas valve, the high pressure gas outlet pipe of the device being connected with a gas delivery pipe in an oil well, the low pressure gas outlet of the device being connected with a gas recovery pipe of the high pressure gas resource, the oil outlet of the device being connected with an oil transferring pipe; and the oil-gas-ball inlet of the devise being connected with a gas lift pipe of the oil well; introducing high pressure gas into the annular space between the casing and tubing of the oil well to push the liquid level in the oil well to a required depth; then starting the electric control unit of the gas-lift-ball control device so that the shift fork drives the gas-lift-balls successively into the ball inlet hole of the valve body of the valve for sending out balls; at the same time, the valve core of the valve for sending out balls is driven so that the passage means connects the ball inlet hole with the low pressure gas hole in the valve body and connects the high pressure inlet hole with the high pressure outlet hole in the valve body alternatively, whereby gas and the balls are sent into the gas delivery pipe successively and the balls together with the oil and gas coming from a tailpipe enter the gas lift pipe; and then the mixture of oil, gas and balls flows into the separator shell to separate the oil, gas and balls so that the separated gas and ball will be reused and the separated oil will be transferred to a metering station.

* * * * *

UNITED STATES PATENT AND TRADEMARK OFFICE

CERTIFICATE OF CORRECTION

PATENT NO. : 6,293,340 B1
DATED : September 25, 2001
INVENTOR(S) : Wu

It is certified that error appears in the above-identified patent and that said Letters Patent is hereby corrected as shown below:

Column 1,
Line 19, change “it’s” to -- its --;
Line 30, change “A valves” to -- ??? --;

Column 2,
Line 32, change “an” to -- and --;

Column 3,
Line 29, change “alternatively” to -- alternately --;

Column 4,
Line 63, change “is” to -- are --;

Column 5,
Line 64, (second occurrence), change “and” to -- end --;

Column 6,
Line 17, change “smaller” to -- small --;
Lines 19 and 47, change “devise” to -- device --;

Column 10,
Line 8, change “an” to -- and --;
Lines 15 and 22, change “devise” to -- device --.

Signed and Sealed this

Fourteenth Day of January, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,293,340 B1
DATED : September 25, 2001
INVENTOR(S) : Chenglin Wu

It is certified that error appears in the above-identified patent and that said Letters Patent is hereby corrected as shown below:

This certificate supersedes Certificate of Correction issued January 14, 2003, the number was erroneously mentioned and should be vacated since Certificate of Correction should not have been granted.

Signed and Sealed this

Fifteenth Day of April, 2003

JAMES E. ROGAN
*Director of the United States Patent and Trademark Office*